US005102572A

United States Patent [19]

Borland et al.

[11] Patent Number: 5,102,572

[45] Date of Patent: Apr. 7, 1992

[54] LIME SOAP DISPERSANT COMPRISING SODIUM COCOYL GLYCERYL SULFONATE AND N-ALKYL-N,N-DIMETHYLAMINE OXIDE

[75] Inventors: James E. Borland; Joe D. Sauer; Kim R. Smith, all of Baton Rouge

[73] Assignee: Ethyl Corporation, Richmond, Va.

[21] Appl. No.: 542,308

[22] Filed: Jun. 22, 1990

[51] Int. Cl.[5] ..... C11D 9/30; C11D 9/00

[52] U.S. Cl. ..... 252/117; 252/108; 252/132; 252/134; 252/121; 252/547; 252/552; 252/DIG. 5; 252/DIG. 16

[58] Field of Search ..... 252/108, 117, 132, 134, 252/DIG. 5, DIG. 16, 547, 552, 121

[56] References Cited

U.S. PATENT DOCUMENTS 4,265,777 5/1981 Boyer et al. ..... 252/113

FOREIGN PATENT DOCUMENTS 57-74397 5/1982 Japan .

*Primary Examiner*—Paul Lieberman
*Assistant Examiner*—Mary C. DiNunzio
*Attorney, Agent, or Firm*—Patricia J. Hogan

[57] ABSTRACT

A bar soap composition containing a fatty acid soap is provided with superior lime soap dispersing properties by the inclusion therein of a synergistic mixture of (1) an N-alkyl-N,N-dimethylamine oxide in which the alkyl group contains 8–20 carbons and (2) sodium cocoyl glyceryl sulfonate in a weight ratio of about 0.05–2.3/1.

10 Claims, No Drawings

LIME SOAP DISPERSANT COMPRISING SODIUM COCOYL GLYCERYL SULFONATE AND N-ALKYL-N,N-DIMETHYLAMINE OXIDE

FIELD OF THE INVENTION

This invention relates to soap compositions and more particularly to fatty acid soap compositions having superior lime soap dispersing properties.

BACKGROUND

It is known that the use of fatty acid soap compositions in water containing calcium and/or magnesium ions leads to the deposition of insoluble lime soap and that this deposition is conducive to the scum frequently seen in sinks and bathtubs. The use of a detergent as a lime soap dispersant can prevent this deposition, but lime soap dispersants that have previously been used in soap compositions have not been sufficiently efficient.

Both sodium cocoyl glyceryl sulfonate and N-alkyl-N,N-dimethylamine oxides having 8–20 carbons in the alkyl group are known surfactants. However, the amine oxides have not found wide application in the formulation of toilet soap bars because of having been available only as dilute aqueous solutions which lead to a decomposition problem when the excess water is removed at normal evaporation temperatures and which lead to a frothing problem when the excess water is removed at lower temperatures under vacuum.

As taught in copending application Ser. No. 415,910 (Smith et al.), filed Oct. 2, 1989, it has now been found possible to prepare solid N-alkyl-N,N-dimethylamine oxides in a practical manner. Thus, the use of the amine oxides in the formulation of soap bars has become more attractive.

SUMMARY OF THE INVENTION

It has now been found that soap compositions containing both sodium cocoyl glyceryl sulfonate and an N-alkyl-N,N-dimethylamine oxide in which the alkyl group contains 8-20 carbons exhibit a synergistic suppression of the amount of lime soap deposits formed in hard water when the amine oxide and sulfonate are used in a weight ratio of about 0.05–2.3/1.

DETAILED DESCRIPTION

The N-alkyl-N,N-dimethylamine oxides which may be used in the practice of the invention are those in which the alkyl group contains 8–20 carbons, preferably 12–18 carbons. Exemplary of such compounds are those in which the alkyl group is octyl, 2-ethylhexyl, 2-ethyloctyl, decyl, dodecyl, 2-ethyldecyl, tetradecyl, hexadecyl, octadecyl, or eicosyl; and the preferred amine oxides are those in which the alkyl groups are mainly linear primary alkyl groups which are at least 75%, preferably at least 90% straight chain. N-tetradecyl-N,N-dimethylamine oxide and N-hexadecyl-N,N-dimethylamine oxide are especially preferred.

Although the amine oxide may be introduced into the soap composition as a conventional dilute aqueous solution, it is ordinarily preferred to avoid the consequences of using a dilute solution by utilizing a solid or liquid amine oxide which does not contain excess water. This amine oxide may be anhydrous, or it may be a monohydrate or dihydrate; and mixtures of anhydrous amine oxide, amine oxide monohydrate, and amine oxide dihydrate are also utilizable.

In a preferred embodiment of the invention, the amine oxide is a product prepared by the process of Smith et al., the teachings of which are incorporated herein in toto by reference. More specifically, it is an amine oxide prepared by (1) oxidizing the corresponding N-alkyl-N,N-dimethylamine with aqueous hydrogen peroxide in an organic solvent, such as ethyl acetate or other such ester, in which the amine and product amine oxide are soluble at the reaction temperatures but in which the product is insoluble at an ambient or lower temperature and (2) adjusting the water content of the product, if necessary, to achieve a water/amine oxide mol ratio of about 1.9–2.1/1. The product of such a reaction is an amine oxide dihydrate or a mixture thereof with the corresponding anhydrous amine oxide and/or the corresponding amine oxide monohydrate; and it may be a liquid or solid, depending on its molecular weight. When the amine oxide is a dihydrate, it melts at about 15° C. when the alkyl group is octyl, about 22°–23° C. when the alkyl group is decyl, 30°–31° C. when the alkyl group is dodecyl, and still higher temperatures as the alkyl group is further lengthened.

As already indicated, the N-alkyl-N,N-dimethylamine oxide/sodium cocoyl glyceryl sulfonate weight ratio in the soap composition should be in the range of about 0.05–2.3/1 in order to achieve synergism in suppressing lime soap deposits; and this ratio is preferably about 0.25–1.5/1, more preferably about 0.3–1.2/1.

The amount of each component of the synergistic mixture used in the soap composition generally varies from about 1–40%, preferably about 5–25%, based on the total weight of the composition; and it is a surprising feature of the invention that the synergism between the components of the mixture makes it possible for the lime soap dispersant to be effective when used in amounts that are less than 15%, and sometimes even less than 10% by weight, based on the weight of the fatty acid soap component of the composition.

Except for the inclusion of the lime soap dispersant of the invention, the soap composition is a conventional one. Thus, it generally contains about 5–95%, preferably about 10–90%, and most preferably about 25–75% by weight of a fatty acid soap and may contain other components, such as titanium dioxide, glycerol or other polyol moisturizer, fragrances, bactericides, fungicides, dyes, fatty acids, polyglycols, alkanolamines, witch hazel, citric acid, opalescent agents, opacity agents, water, and additional synthetic detergents.

Synthetic detergents which may be used in combination with the lime soap dispersant include sodium cocoyl N-methyltauride, sodium oleylsulfate, sodium monolauryl sulfosuccinate, the sodium salt of a monooleic acid ester of glycerol sulfate, sodium lauryl sulfoacetate, sodium isostearoyl-2-lactylate, lauryl diethanolamide, and the like. When used, the optional detergent may be employed in an amount such as to constitute up to about 80% of the weight of the soap composition, e.g., about 10–75% of that weight.

The fatty acid soap which is an essential component of the soap composition may be any conventional soap, such as an alkali metal or ammonium salt obtained by reacting a neutralizing agent, such as an alkali metal hydroxide, triethanolamine, or coco diethanolamine, preferably sodium hydroxide, with one or more fatty acids, such as tallow acid, oleic acid, stearic acid, or coco acid, very usefully an 80/20 mixture of tallow and coco fatty acids.

The soap composition of the invention may be prepared by conventional procedures as long as any heating that could decompose the amine oxide is accomplished before the amine oxide is incorporated. Since the amine oxides decompose at elevated temperatures, heating above 100° C. is preferably avoided, and heating above 120° C. should certainly be avoided after the amine oxide has been incorporated.

A particularly useful method of preparing the formulation is to pre-mix all ingredients that require drying, heat this pre-mixture to drive off water until the desired water content (usually about 10%) is achieved, feed the dehydrated mixture to a three-roll mill together with the amine oxide and any other ingredients, thoroughly blend the mixture, extrude it into an elongated log, cut the log into soap bar-size segments, and place each segment in a two-piece mold in which it is compressed to form the final soap bar.

The following examples are given to illustrate the invention and are not intended as a limitation thereof. Unless otherwise specified, quantities mentioned in the examples are quantities by weight.

EXAMPLE I

Preparation of Amine Oxide

Charge a suitable reaction vessel with 100g of N-tetra-decyl-N,N-dimethylamine and 0.5 g of diethylenetriaminepentaacetic acid. Heat with stirring to 65° C., add 23 g of 70% aqueous hydrogen peroxide dropwise over a period of 15 minutes, heat the mixture to 76° C., and stir at that temperature for seven hours. Add 34 mL of ethyl acetate dropwise as needed to maintain a clear, gel-free liquid. Add an additional 400 mL of ethyl acetate to the crude reaction mass, which NMR shows to have reached 99% amine conversion. Cool the resultant solution to 15° C. to form a nonhygroscopic, white, crystalline, solid N-tetradecyl-N,N-dimethylamine oxide dihydrate melting at about 41° C. in 86% recovered yield.

EXAMPLE II

Test of Lime Soap Dispersancy

Test the lime soap dispersancy of N-tetradecyl-N,N-dimethylamine oxide dihydrate, sodium cocoyl glyceryl sulfonate, and mixtures thereof by (1) adding a measured amount of the dispersing agent to 10 mL of a 1% calcium stearate slurry, (2) shaking the resultant sample in a test tube while also shaking a control containing no dispersant in another test tube, (3) comparing the test tubes for complete dispersion of the calcium stearate after allowing them to stand for two minutes, and (4) varying the amount of dispersant added to the slurry to determine the minimum amount of dispersant required to attain complete dispersion of 100 g of calcium stearate. The dispersants used and the minimum amounts required are shown below.

| Dispersant | Amount |
|---|---|
| Amine oxide | 15 g |
| Amine oxide/sulfonate (1/3) | 9 g |
| Amine oxide/sulfonate (1/1) | 6 g |
| Amine oxide/sulfonate (3/1) | 15 g |
| Sulfonate | 16 g |

What is claimed is:

1. A bar soap composition containing 5–95% by weight of a fatty acid soap and at least 1% of each component in the synergistic mixture, not to exceed a combined total of 15%, based on the weight of the fatty acid soap, of a synergistic mixture of (1) an N-alkyl-N,N-dimethylamine oxide in which the alkyl group contains 8–20 carbons and (2) sodium cocoyl glyceryl sulfonate in a weight ratio of about 0.05–2.3/1 as a lime soap dispersant.

2. The composition of claim 1, containing 5–95% by weight of the fatty acid soap.

3. The composition of claim 2 containing 10–90% by weight of the fatty acid soap.

4. The composition of claim 1 containing less than 10% by weight of the lime soap dispersant, based on the weight of the fatty acid soap.

5. The composition of claim 1 wherein the amine oxide/sulfonate weight ratio is about 0.25–1.5/1.

6. The composition of claim 5 wherein the amine oxide/sulfonate weight ratio is about 0.3–1.2/1.

7. The composition of claim 5 wherein the alkyl group of 8–20 carbons is a mainly linear primary alkyl group.

8. The composition of claim 7 wherein the alkyl group contains 12–18 carbons.

9. The composition of claim 8 wherein the amine oxide is N-tetradecyl-N,N-dimethylamine oxide.

10. A bar soap composition containing 25–75% by weight a fatty acid soap and at least 1% of each component in the synergistic mixture, not to exceed a combined total of 10%, based on the weight of the fatty acid soap, of a synergistic mixture of N-tetradecyl-N,N-dimethylamine oxide and sodium cocoyl glyceryl sulfonate in a weight ratio of about 0.3–1.2/1.

* * * * *

UNITED STATES PATENT AND TRADEMARK OFFICE

CERTIFICATE OF CORRECTION

PATENT NO. : 5,102,572

DATED : April 7, 1992

INVENTOR(S) : James E. Borland, Joe D. Sauer, and Kim R. Smith

It is certified that error appears in the above-identified patent and that said Letters Patent is hereby corrected as shown below:

Column 4, after last line thereof, add the following claim:

--11. The composition of claim 2 containing 25-75% by weight of the fatty acid soap.--

Signed and Sealed this

Seventeenth Day of August, 1993

Bruce Lehman

*Attest:*

BRUCE LEHMAN

*Attesting Officer*

*Commissioner of Patents and Trademarks*